United States Patent [19]

Sokol

[11] 4,161,903

[45] Jul. 24, 1979

[54] FILAMENT TENSIONING DEVICE FOR BOBBINS OF A BRAIDING MACHINE, OR THE LIKE

[76] Inventor: Vincent Sokol, 93 Sunnyside Dr., Yonkers, N.Y. 10705

[21] Appl. No.: 897,386

[22] Filed: Apr. 18, 1978

[51] Int. Cl.[2] ..... D04C 3/14

[52] U.S. Cl. ..... 87/57; 87/22; 242/156

[58] Field of Search ..... 87/21, 22, 56, 57; 242/75.43, 156, 156.2

[56] References Cited

U.S. PATENT DOCUMENTS

| | | | |
|---|---|---|---|
| 2,576,936 | 12/1951 | Heffelfinger | 242/156 X |
| 3,054,572 | 9/1962 | Williams et al. | 242/156.2 UX |
| 3,160,238 | 12/1964 | Meyer-Jagenberg | 242/156.2 X |
| 3,362,282 | 1/1968 | Karg | 87/57 X |
| 3,425,315 | 2/1969 | Kaufmann | 87/57 X |
| 3,757,904 | 9/1973 | Deyoung | 87/57 X |
| 3,787,001 | 1/1974 | Henry | 242/75.43 |

*Primary Examiner*—John Petrakes

*Attorney, Agent, or Firm*—Ostrolenk, Faber, Gerb & Soffen

[57] ABSTRACT

Filament is unwound under tension from a bobbin; a brake controls the speed of rotation of the bobbin; the brake includes one clutch plate that rotates with the bobbin and another clutch plate that is hydraulically urged against the first clutch plate; a self-container hydraulic fluid filled, hydraulic system communicates with the latter clutch plate and also with a piston; biasing means urge the piston to increase the pressure on the latter clutch plate which brakes the bobbin and increases filament tension; as the filament is drawn away from the bobbin under greater tension, the piston is urged, against the force of biasing means, to reduce the pressure on the latter clutch plate which releases the brake and decreases filament tension.

23 Claims, 6 Drawing Figures

FIG. 1.
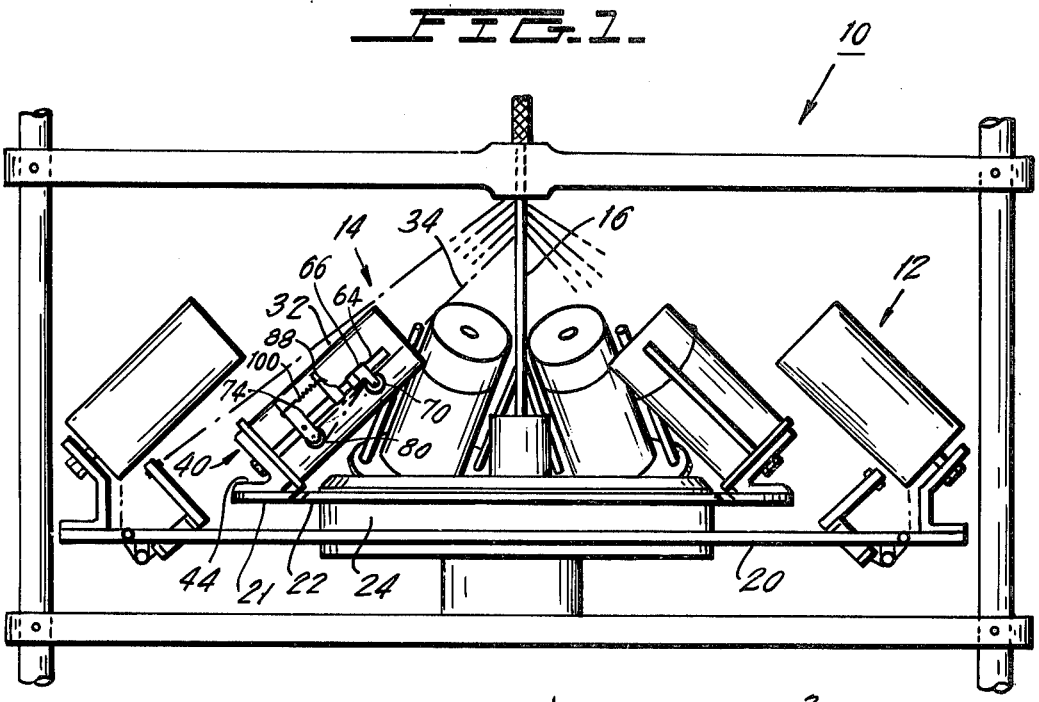
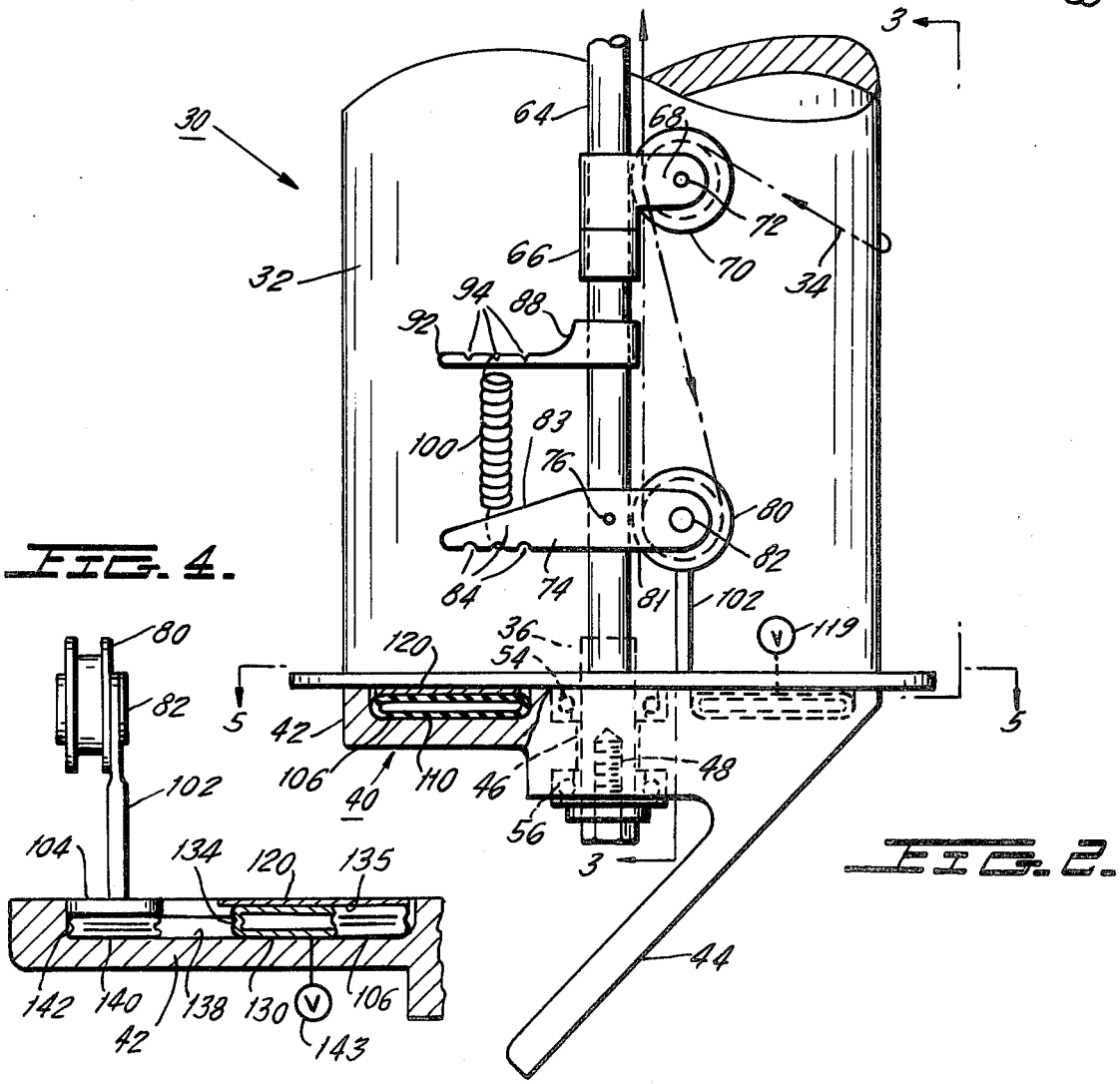
FIG. 4.
FIG. 2.

FILAMENT TENSIONING DEVICE FOR BOBBINS OF A BRAIDING MACHINE, OR THE LIKE

BACKGROUND OF THE INVENTION

The present invention relates to filament bobbins and to means for maintaining a substantially constant tension on the filaments being unwound from the bobbins. In particular, the invention is applicable to the bobbins of braiding machines. But, it may be used in connection with filaments that are being interlaced, woven, spiraled or wrapped around a core.

Various mechanisms are known for controlling the rates of rotation of individual bobbins and the tension of the filaments. See for example U.S. Pat. Nos. 3,362,282 and 3,757,904. Prior art mechanism for controlling the tension on the filaments are relatively complicated mechanical structures and may not provide uniform tensioning of the filaments throughout their unwinding.

SUMMARY OF THE INVENTION

The present invention covers a hydraulically controlled filament tension adjusting brake. In a preferred embodiment, the brake comprises a closed, hydraulic liquid filled chamber. Biasing means are connected with the chamber for normally increasing the hydraulic pressure in the chamber. The unwinding filament is connected to the chamber such that as the tension on the filament increases, it operates against the biasing means and reduces the hydraulic pressure in the closed chamber and thereby reduces the braking force on the bobbin and decreases the tension of the filament. On the other hand, as the tension on the filament decreases, the biasing means is enabled to increase the pressure in the hydraulic chamber, which increases the braking force on the bobbin, and thereby increases the tension on the filament. Throughout the tensioned unwinding of the filament, the braking force on the bobbin is continuously automatically varied in an inverse relationship to the tension on the filament, thereby maintaining substantially constant tension on the filament being unwound.

Although a completely closed hydraulic system is preferred, a more conventional hydraulic brake system, including a brake fluid reservoir, may be employed. In this case, an operator for the hydraulic system would be connected to the filament to sense its tension and a biasing means would normally bias the hydraulic system to brake the rotating bobbin. The braking force on the bobbin would, similarly to the preferred embodiment, vary inversely with the filament tension.

In the preferred embodiment of the invention, the closed hydraulic system communicates with and applies pressure to a clutch plate, which rubbingly engages the rotating bobbin with a force that varies with the hydraulic pressure in the chamber. The bobbin has a cooperating clutch plate thereon which rotates therewith and is engaged by the clutch plate of the hydraulic system.

In the preferred embodiment, the tensioned filament is connected with the hydraulic chamber by a piston, which is biased to apply elevation pressure to the chamber and which the tensioned filament biases away from applying such pressure to the chamber. This respectively increases and decreases the braking force on the bobbin. The unwinding filament passes around a pulley or guide on the piston and travels along a pathway which causes the filament under tension to urge the piston to reduce pressure in the chamber.

Various embodiments of hydraulic chambers may be used. One preferred embodiment comprises a flexible, sealed closed, hydraulic fluid filled tube. The tube is contained in a molded chamber or other suitable framework to prevent its bulging or becoming misshapen during operation. The piston applies pressure to one section of the tube and the applied pressure is transmitted by the hydraulic fluid to increase the hydraulic pressure in the entire chamber. A clutch plate is placed outside of and is lodged against the tube and the increasing hydraulic pressure biases the clutch plate into contact with a cooperating clutch plate that rotates with the bobbin. As the piston increases the presssure it applied to the hydraulic fluid, the braking force applied by the first mentioned clutch plate is increased. The opposite result occurs when the piston decreases the pressure it applies to the hydraulic fluid. The just described embodiment of hydraulic brake is useful for relatively lesser levels of tension on the filament, e.g. no more than 10 pounds of pulling force.

An alternate embodiment of the invention is useful for filaments tensioned at a higher level, although it is not limited to use with more highly tensioned filaments. In this embodiment, in place of a flexible tube defining the hydraulic chamber, a metal bellows defines the hydraulic chamber. The clutch plate associated with the hydraulic chamber is located outside of and is lodged against one wall of the bellows. The bellows associated with the clutch plate is in fluid communication with a separate bellows with which the pressurizing piston cooperates. The increase and decrease of tension on the filament causes the piston to increase and decrease the pressure on its associated bellows. In the same manner as with the first described embodiment, pressure changes in the piston bellows are directly communicated to the clutch plate bellows to correspondingly vary the braking force on the bobbin and the tension of the filament.

Both embodiments of the hydraulic chamber are sealed in use. But, as the clutch plate wears, the pressure piston may bottom. The chamber is thus fillable to add needed additional fluid to prevent such bottoming and to replace any possibly leaked fluid.

As a further feature of the invention, the bobbin may have a continuously operating, conventional mechanical drag brake operating on it for applying a continuous minimum tension to the filament, reducing the wear of the hydraulic brake. For example, the mechanical drag brake may be manually preset at about one half the desired filament tension.

Accordingly, it is the primary object of the present invention to control the tension of a filament being unwound from a bobbin or spool.

It is another object of the present invention to continuously monitor the filament for tension, continuously modifying the braking force on the bobbin from which the filament is being unwound.

It is the further object of the invention to control the tension on the filament by means of a brake which is caused to control the tension of the filament itself.

The foregoing and other objects and features of the invention will become apparent from the following description taken in conjunction with the accompanying drawings.

BRIEF DESCRIPTION OF THE DRAWINGS

FIG. 1 schematically illustrates one form of braiding machine in which one embodiment of the hydraulic brake of the invention is included;

FIG. 2 is a side view, partially in cross-section of a bobbin provided with the one embodiment of the brake according to the invention;

FIG. 4 is a view of a fragment of the apparatus of FIG. 3 showing a second embodiment of the brake of the invention;

DESCRIPTION OF THE PREFERRED EMBODIMENTS

Figure 5:
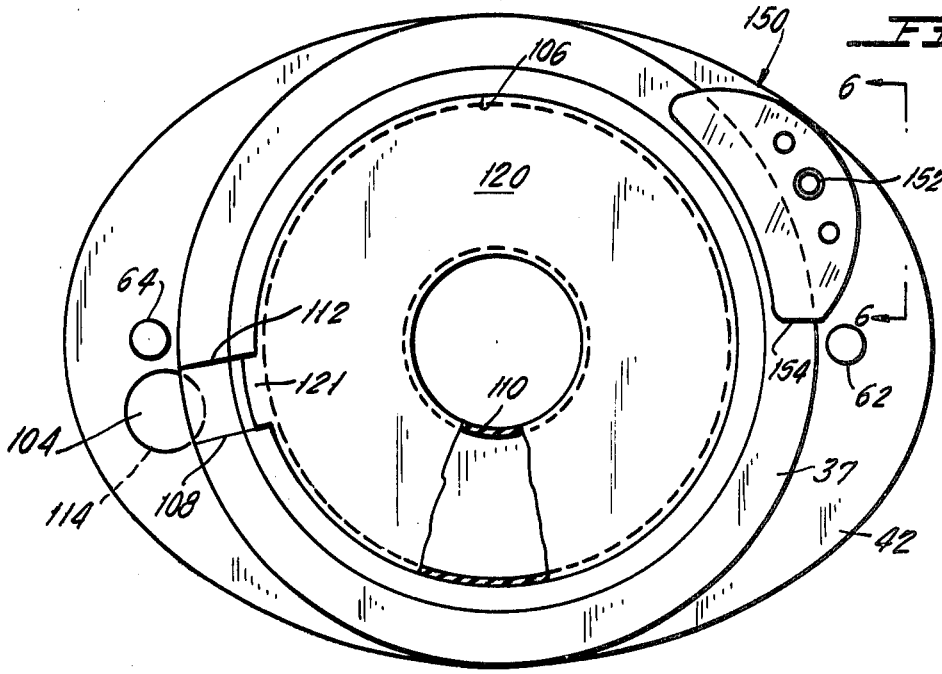
FIG. 5 is a top view of the base of the bobbin shown in FIG. 3 along the line 5—5 in FIG. 3 and showing an optional mechanical drag brake for the bobbin.

Referring to FIG. 1, a braiding machine generally of the type shown in U.S. Pat. No. 3,892,161 and/or the type shown in U.S. application Ser. No. 877,980, filed Feb. 15, 1978 is illustrated in FIG. 1. The brading machine 10 comprises an outer annular array 12 of bobbins or spools of filament to be braided and an inner annular array 14 of bobbins or spools of filament to be braided. The respective filaments from the bobbins of both arrays are led to and braided on the central mandrel 16. The outer array of bobbins 12 are carried on a plate 20 which is adapted to rotate in one direction, e.g. clockwise. The inner array of bobbins are carried on a respective support means 21 and these bobbins are drivingly connected, in the manner disclosed in the aforesaid patent, by the second plate 22, which is adapted to rotate in the opposite direction, e.g. counterclockwise. Appropriate driving means 24 drive the plate 20, 22 in opposite directions at the same rate. As the bobbin arrays rotate, their filaments are wrapped around the mandrel 16, and this draws the respective filaments off their bobbins. The bobbins rotate or spin about their own axes on their support brackets as the filaments are drawn off. Other features of such a braiding machine may be learned from the aforesaid applications and patents.

For the braid to be uniform and tight to the correct extent, all of the filaments must be at a preselected tension. Preferably, the tension on all of the filaments is the same. For example, all of the filaments might be tensioned at 10 pounds of pulling force. The level of tension is obviously a matter of choice.

The tensioning device according to the invention is adapted for use with both the inner and outer array bobbins 14 and 12. It is now described in connection with a typical inner array bobbin 30. Referring to FIG. 2, the inner array bobbin 30 comprises a bobbin or spool 32 that is wound with filament material, such as wire 34. The filament is wound around the bobbin 32 over the full axial height of the bobbin. As the filament 34 is unwound, therefore, its point of separation from the bobbin 32 travels up and down the height of the bobbin.

The base of the bobbin includes an integral shaft 36, which projects from the bottom of the bobbin through the mounting bracket 40 means therefor. At the underside of the bobbin 32, just above the upper surface of the below described bracket 42, the shaft 36 of the spool 32 has fixedly attached to it the brake clutch plate 37. The clutch plate 37 is comprised of metal. It has a flat, generally smooth underside which cooperates with a below described brake clutch plate 120 supported on the bracket 42 and resting on the hydraulic chamber 110.

The bobbin 30 is held to the mounting bracket means 40, which comprises the bobbin support bracket 42 and the supporting arm 44. Arm 44 is integral with the bracket 42 and which is the part of the mounting bracket 40 that is supported by the support means 21 and is drivingly connected to the support plate 22. The bracket 42 has a bore 46 passing through it which defines a close fit clearance opening for the bobbin shaft 36. The lower end of the bobbin shaft 36 has a threaded opening 48 extending into it for receiving the threaded bolt 49 therein. The bolt holds a support washer 51 against the bracket 42, thereby securing the bobbin to the bracket.

There is positioned in the bore 46 two axially separated thrust bearings 54 and 56 which receive and facilitate the rotation of the shaft 36 and the bobbin 32 with respect to the non-rotating bracket 42. The washer 51 is secured down by the bolt 49 against the thrust bearing 56.

The tensioning device of the invention controls the rate at which the bobbin 32 spins with respect to the bracket 42.

In addition to supporting the bobbin 32, the bracket 42 has side posts 62 and 64 that are screwed into threaded receiving openings therefor in the bracket 42. As the filament 34 is unwound from and first leaves the bobbin 32, it passes around the outside of the post 62 and is guided away from the bobbin.

The post 64 supports a number of the elements of the tensioning device. A sleeve 66 is adjustable in its position along and is then secured to the post 64. The sleeve 66 carries the supporting ears 68 to which a pulley wheel 70 is rotatably attached at pivot 72. The position of the sleeve 66 along the post 64 is set so that the filament 34 will always wrap partially around the pulley 70 and be continuously directed down to the below described filament tension responsive pulley wheel 80.

Farther down along the post 64, there is a pivoting lever 74 which is pivotally attached to the post 64 at the pivot 76. A filament tension responsive pulley wheel 80 is rotatably attached to the arm 81 of lever 74 at the pivot 82. Any movement of the pulley 80 vertically will correspondingly swivel the lever 74 about its pivot.

On the arm 83 of the lever 74, at the other side of the pivot 76 from the pulley wheel 80, the lever 74 is provided with a plurality of tensioning device adjustment notches 84. As will be apparent from the description below, the connection of a biasing means for the lever 74 to different respective notches 84 adjusts the brake force exerted on the bobbin 32 by the below described brake and thus adjusts the tension on the filament 34.

Spaced up along the post 64 from the lever 74 is the sleeve 88, which is affixed to the post 64. The position of the lever 74 is fixed by its pivot 76. But the sleeve 88 can be adjusted in height. However, for typical adjustments according to the invention, the sleeve 88 would be fixed in position along the post 64.

The sleeve 88 supports an arm 92 which projects out from the sleeve. The sleeve 88 is oriented such that the arm 92 is over and extends parallel to the arm 83 of the lever 74 that carries the notches 84. The arm 92 also has tensioning device adjustment notches 94 defined on its upper surface.

A tension spring 100 extends between a selected notch 84 on the arm 83 and a selected notch 94 on the arm 92. The spring 100 is tensioned to normally attempt to pivot the lever 74 clockwise in FIG. 2. This biases the pulley wheel 80 downwardly with a predetermined force. This force on the pulley wheel 80 brakes the rotation of the bobbin 32 and tensions the filament.

One method of adjusting the biasing force applied at the pulley wheel 80 is to adjust the length of the moment arm to which the tensioned spring 100 applies its force. For making such adjustment, the spring 100 is shifted between different respective sets of the notches 84 and 94. The same spring 100 causes the pulley wheel 80 to apply a greater force when the spring is in the notches 94, 84 at the left in FIG. 2 and a smaller braking force when the spring is in the notches 84, 94 at the right in FIG. 2.

The axis 82 of the pulley wheel 80 is drivingly connected with the piston 102. The actual movements of the pulley wheel 80 and the piston 102 are minimal. The principal influence of the pulley wheel 80 and the piston 102 are to apply greater or smaller amounts of pressure on the below described hydraulic chamber 110. The piston 102 has a pressure element 104 integrally attached at the lower end thereof and the pressure element 104 selectively applies greater or lesser pressure to the hydraulic chamber 110 for varying the filament tension.

The bracket 42 includes a molded, cast or milled opening 106 formed into its upper surface. The opening 106 is annular in shape and shallow in depth. The opening 106 includes an extension 108 which leads to and communicates beneath the piston 102, 104.

Inside the opening 106 is placed a hydraulic chamber comprised of an enclosed flexible tube 110 comprised of neoprene rubber, or the like, which is shaped and sized to fill the opening 106, and when tube 106 is full, it completely the opening 106. The tube 110 includes an integral extension 112 thereof and includes an integral section 114 directly beneath the piston element 104. The tube extension 112 and section 114 completely fill the extension 108 of the opening 106. The tube extension 112 serves as a key which orients the tube and which blocks annular motion of the tube. The tube 110, 112, 114 is filled with an appropriate liquid hydraulic fluid. Care should be taken to eliminate any air bubbles or other compressible fluids from within the tube. The tube 110 is completely sealed and no fluid should normally be added thereto and none should be able to be removed therefrom.

Through prolonged use, the clutch plates, and particularly clutch plate 120, may wear. Eventually, during braking motion of piston 102, 104, the worn clutch plate 120 may shift enough to cause piston 102, 104 to bottom in opening 106. The tube 110 therefore has a normally closed, conventional bleeding and refill valve 119 connected to it, through which additional fluid may be added as needed and through which trapped air might be bled, without hydraulic fluid leaking out.

Seated atop and outside the upper side of the flexible tube 110 there is an annular, disc-like clutch plate 120. The clutch plate 120 is comprised of metal so that it may rubbingly engage the clutch plate 37 without appreciable damage to either of them over a considerable period of time. The underside of the clutch plate 120 seats directly on the tube 110 and thereby is exposed to the hydraulic pressure within the tube 110. The top side of the clutch plate 120 rubbingly engages the above described clutch plate 37. The disc-like clutch plate includes a short radial keying projection 121 at one side thereof, of a width and size to snugly fit between the side walls of opening extension 108, for preventing rotation of the plate 120 with respect to tube 110 or bracket 42, especially when plate 120 rubbingly engages clutch plate 37. The length of projection 121 is short enough that it does not extend beneath piston 102, 104.

When the hydraulic chamber in tube 110 is pressurized, the wall of the tube is pressurized and the clutch plate 120 is biased upwardly with respect to the bracket 42 and the top side of the plate 120 is pressed securely into engagement with the underside of the clutch plate 37. As the pressure on the clutch plate 120 increases, the force it exerts upon the cooperating clutch plate 37 correspondingly increases and this exerts greater drag upon the spool 32 which correspondingly increases the tension on the filament 34.

The piston 102, 104 is the means by which the pressure in the sealed tube 110 is varied, thereby to vary the braking force. Normally, the spring 100 urges the pulley wheel 80 and piston 102, 104 relatively strongly down on the section 114 of the tube 110. This increases the hydraulic pressure in the tube and applies relatively great pressure upon the plate 120, and the pressure increases the braking force on the clutch plate 37. If the filament 34 is placed under higher tension, because of the way in which the filament passes the pulley wheel 80, the filament pulls up on the pulley wheel 80 against the bias of the spring 100. As the pulley wheel 80 and piston 102, 104 attempt to rise, this immediately decreases the force exerted by the piston 102, 104 on the tube section 114, which decreases the pressure in the tube 110 and decreases the braking force exerted by the clutch plate 120. With the brake slightly released, the tension on the filament 34 decreases, which enables the spring 100 to bias the pulley wheel 80 and the associated piston 102, 104 to exert increasing force on the tube section 114, increasing the pressure in tube 110 and increasing the braking force exerted by the clutch plate 120. Eventually, a substantially stable filament tension condition is achieved. The stable filament tension condition can be adjusted by movement of the position of the spring 100 to seat in different notches 84, 94.

Figure 3:
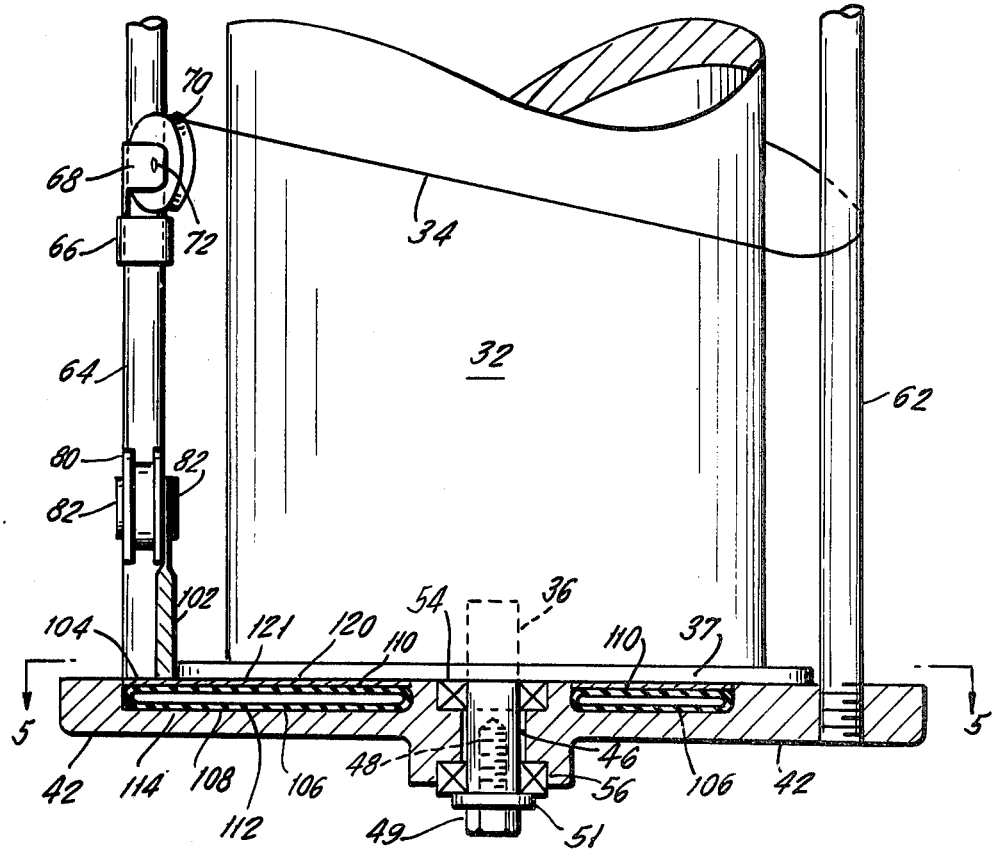
FIG. 3 is an elevational view, partially in cross-section, of the apparatus shown in FIG. 2 along the line 3—3.

The alternate embodiment of FIG. 4 has the same structure as the embodiment of FIGS. 2 and 3, with the exception of the construction of the hydraulic fluid containing chamber. Therefore, only the structure that is different for the second embodiment is illustrated in FIG. 4. Those elements shown in FIG. 4 which correspond to the elements in the first embodiment are correspondingly numbered.

The opening 106 in the bracket 42 in FIG. 4 is also a shallow opening milled into the top surface of the bracket or cast when the bracket is initially cast. In this embodiment, the hydraulic chamber is defined and enclosed by a metallic bellows 130, whose peripheral wall 134 is flexible enough to enable the outwardly facing top wall 135 of the bellows 130 to apply varying braking force to the cooperating keyed clutch plate 120 above the bellows. As in the first embodiment, the clutch plate 120 sits atop the bellows 130 and is biased by the pressure in the bellows 130. As the pressure in the chamber 130 alternatively increases and decreases, the clutch plate 120 respectively exerts greater and lesser braking force against the bobbin clutch plate 37.

The hydraulic passageway 138 joins the main hydraulic chamber and bellows 130 with a smaller size secondary bellows 140 on which the piston 102, 104 applies pressure. The peripheral wall 142 of the bellows 40 also is sufficiently flexible to enable the pressure in the bellows 140 to be varied by changes in the force exerted on the bellows 140 by the piston 102, 104. The increases and decreases in pressure in the bellows 140 respectively cause corresponding increases and decreases in the pressure in the bellows 130, thereby respectively increasing and decreasing the braking force and the tension on the filament 34. The system comprised of the bellows 130,132 and 140 is a completely closed hydraulic system filled with a liquid hydraulic fluid and from which air and compressible fluids have been eliminated.

Similar to the first embodiment, the second embodiment of bellows 130, 140 has a normally closed bleeding and refill valve 143 connected to it for enabling insertion of additional hydraulic fluid and removal of trapped air.

Figure 6:
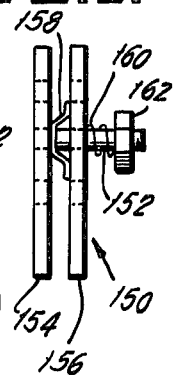
FIG. 6 is a detailed view of the mechanical drag brake shown in FIG. 5, viewed in the direction of arrows 6—6 in FIG. 5.

Returning to the first embodiment, although the following is applicable to the second embodiment as well, and referring to FIGS. 5 and 6, in order to ensure that a minimum level of tensioning of the filament is maintained and to also reduce the amount of frictional drag which the cooperating clutch plates 37, 120 must exert upon each other, thereby reducing wear of the clutch plates, a more conventional mechanical drag brake 150 is supported on the bracket 42 and engages the clutch plate 37 for mechanically restraining rotation of the bobbin 32 and thereby applying a minimum level of tension to the filament 34. For example, when the filament is to be tensioned to about 10 pounds of pull, the mechanical drag brake 150 might be set to exert a constant tension of 5 pounds of pull, whereby the hydraulic brake of the invention only needs to apply force sufficient to add five additional pounds of pull on the filament. The mechanical drag brake includes a shaft 152 which is carried in the bracket 42. An axially stationary, non-rotatable plate 154 engages the top surface of the clutch plate disc 37. A lower plate 156, which is axially movable along shaft 152 but which is not rotatable, engages the undersurface of the clutch plate disc 37, whereby the disc 37 is sandwiched between the plates 154 and 156. A resilient spacer washer 158 between the plates 154, 156 maintains their substantially parallel orientation during use. A spring 160 biases the movable plate 156 toward the plate 154. The threaded adjustment nut is threadedly movable along the threaded shaft 152 for adjusting the extent to which the spring 160 is charged, thereby to adjust the braking force exerted by the plates 154, 156 on the brake clutch disc 37.

Although not illustrated in the drawings, one skilled in the art could adapt the invention to employ a more standard hydraulic brake system using a reservoir of fluid. The piston associated with the filament would, like a brake operator, increase or decrease the hydraulic pressure in the brake chamber and operate the clutch.

There has just been described a number of embodiments of a tensioning device for maintaining a constant predetermined tension on filament being unwound from a rotating bobbin, wherein hydraulic pressure in a hydraulic chamber which operates a brake for the rotating bobbin is varied inversely with the tension on the filament, such that as the tension of the filament increases, the pressure in the hydraulic chamber decreases, and vice versa.

Although the present invention has been described in connection with a plurality of preferred embodiments thereof, many variations and modifications will now become apparent to those skilled in the art. It is preferred, therefore, that the present invention be limited not by the specific disclosure herein, but only by the appended claims.

What is claimed is:

1. A filament tension regulating device, comprising:

a bobbin for holding filament that is to be unwound under tension; a support bracket for said bobbin with respect to which said bobbin is rotatable as the filament on said bobbin is unwound under tension;

brake means engageable with said bobbin for retarding the rotation of said bobbin with respect to said bracket as the filament is being unwound under tension; said brake means comprising a hydraulic fluid containing chamber; said chamber being connected with said bobbin such that increase in the hydraulic pressure in said chamber applies greater braking force to said bobbin for retarding rotation thereof and a decrease in the hydraulic pressure in said chamber reduces the braking force applied to said bobbin correspondingly releasing said bobbin to rotate with respect to said bracket;

means connecting the filament being unwound under tension with said chamber in a manner such that the pressure in said chamber varies inversely with the tension of the filament.

2. The filament tension regulating device of claim 1, wherein said means connected the filament being unwound with said chamber comprises pressure transmitting means connected with said chamber for varying the pressure in said chamber; means connecting the filament to said pressure transmitting means in a manner such that the filament urges said pressure transmitting means away from causing an increase in the pressure in said chamber and such that as the tension on the filament increases, said pressure transmitting means is correspondingly increasingly urged to cause a decrease in the pressure in said chamber;

biasing means for urging said pressure transmitting means toward increasing pressure in said chamber, whereby as tension on the filament increases, the pressure in said chamber decreases, and as tension on the filament decreases, said biasing means urges said pressure transmitting means to increase the pressure in said chamber.

3. The filament tension regulating device of claim 1, wherein said chamber itself is deformed as the pressure therein is varied and said chamber is connected with said bobbin such that said bobbin is braked to different extents as said chamber is deformed.

4. The filament tension regulating device of claim 3, wherein said brake means further comprises a clutch plate at said chamber and subject to the pressure in said chamber; said clutch plate normally being in engagement with said bobbin and the force exerted by said clutch plate on said bobbin for restraining the rotation thereof varies directly with the pressure in said chamber.

5. The filament tension regulating device of claim 3, wherein said means connecting the filament being unwound with said chamber comprises pressure transmitting means positioned to be in engagement with said chamber for applying pressure to said chamber; means connecting the filament to said pressure transmitting means in a manner such that the filament urges said pressure transmitting means away from applying pressure to said chamber and such that as the tension on the filament increases, said pressure transmitting means is correspondingly increasingly urged away from applying pressure to said chamber;

biasing means for urging said pressure transmitting means toward applying pressure to said chamber, whereby as tension on the filament increases, the pressure in said chamber decreases, and as tension on the filament decreases, said biasing means urges said pressure transmitting means to increase the pressure in said chamber.

6. The filament tension regulating device of claim 5, wherein said bracket includes an opening therein which is shaped for receiving and for containing said chamber; said opening itself opening toward said bobbin; said chamber being in said opening.

7. The filament tension regulating device of claim 6, wherein said chamber comprises a sealed flexible walled housing filled with hydraulic fluid.

8. The filament tension regulating device of claim 6, wherein said chamber comprises a sealed bellows with a flexible peripheral wall.

9. The filament tension regulating device of claim 6, wherein said brake means further comprises a clutch plate at said chamber and subject to the pressure in said chamber; said clutch plate normally being in engagement with said bobbin and the force exerted by said clutch plate on said bobbin for restraining the rotation thereof varies directly with the pressure in said chamber;

said clutch plate being at the side of said chamber for said clutch plate to engage said bobbin.

10. The filament tension regulating device of either of claims 4 or 9, further comprising a second clutch plate attached to and rotatable with said bobbin and positioned so as to be the portion of said bobbin in engagement with the first mentioned said clutch plate.

11. The filament tension regulating device of claim 4, wherein said chamber is annular in shape and said clutch plate at said chamber is also annular in shape.

12. The filament tension regulating device of claim 11, further comprising keying means connected to said clutch plate for preventing relative rotation thereof with respect to said bracket.

13. The filament tension regulating device of either of claims 5 or 6, wherein said chamber comprises a principal portion at said bobbin and a separate portion away from said bobbin and said principal and separate portions being joined; said pressure transmitting means engaging said chamber separate portion.

14. The filament tension regulating device of claims 13, wherein said chamber comprises a sealed flexible walled housing filled with hydraulic fluid.

15. The filament tension regulating device of claim 13, wherein said chamber comprises a sealed bellows with a flexible peripheral wall.

16. The filament tension regulating device of claim 13, wherein said chamber principal portion comprises a sealed bellows with a flexible peripheral wall; said chamber separate portion comprises a separate sealed bellows and which is in engagement with said pressure transmitting means; said chamber principal and separate portions being in sealed hydraulic fluid communication.

17. The filament tension regulating device of claim 13, wherein said pressure transmitting means comprises a piston.

18. The filament tension regulating device of claim 5, further comprising means for adjusting the force of said biasing means, thereby to adjust the level of tension of the filament being unwound under tension.

19. The filament tension regulating device of either of claims 5 or 18, wherein said pressure transmitting means comprises a piston.

20. The filament tension regulating device of any of claims 1, 5 or 18, additionally comprising a mechanical drag brake connected with said bobbin for continuously applying a set level of drag to said bobbin and a set level of tension to said filament and said brake means providing a further level of tension to said filament.

21. A braiding machine for braiding a plurality of filaments, comprising a plurality of said filament tension regulating devices of either of claims 1 or 5; each said bobbin and its respective said brake means being supported on a respective said bracket; said brackets and the respective said bobbins thereof being arranged in two annular arrays; means for rotating each of said annular arrays in a respective opposite direction around a common axis; a mandrel at said axis about which the filament from each said bobbin is wound.

22. The filament tension regulating device of claim 14, further comprising a bleeding and fluid refill valve communicating with said chamber.

23. The filament tension regulating device of claim 15 further comprising a bleeding and fluid refill valve communicating with said chamber.

* * * * *